US011126118B2

(12) United States Patent
Miyata et al.

(10) Patent No.: US 11,126,118 B2
(45) Date of Patent: Sep. 21, 2021

(54) FIXING DEVICE HAVING HEATING MEMBER AND CONTACT PORTION THEREOF AND IMAGE FORMING APPARATUS

(71) Applicant: FUJIFILM Business Innovation Corp., Tokyo (JP)

(72) Inventors: Toshiyuki Miyata, Kanagawa (JP); Jouta Kobayashi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/862,541

(22) Filed: Apr. 29, 2020

(65) Prior Publication Data

US 2021/0103239 A1 Apr. 8, 2021

(30) Foreign Application Priority Data

Oct. 2, 2019 (JP) ..... JP2019-182131

(51) Int. Cl.
*G03G 15/20* (2006.01)
*G03G 15/00* (2006.01)

(52) U.S. Cl.
CPC ..... *G03G 15/2053* (2013.01); *G03G 15/2064* (2013.01); *G03G 15/6555* (2013.01); *G03G 2215/00151* (2013.01); *G03G 2215/2035* (2013.01)

(58) Field of Classification Search
CPC ..... G03G 15/2053; G03G 15/2064; G03G 2215/2035; G03G 2215/00151; G03G 2215/2016
See application file for complete search history.

(56) References Cited

U.S. PATENT DOCUMENTS

| | | | | |
|---|---|---|---|---|
| 2011/0116848 | A1* | 5/2011 | Yamaguchi | G03G 15/2064 399/329 |
| 2017/0176907 | A1* | 6/2017 | Sawada | G03G 15/2028 |
| 2018/0210377 | A1* | 7/2018 | Hashimoto | G03G 15/2017 |
| 2018/0224777 | A1* | 8/2018 | Hashimoto | G03G 15/2053 |
| 2018/0356754 | A1* | 12/2018 | Yoshinaga | G03G 15/2064 |
| 2019/0179241 | A1* | 6/2019 | Kobayashi | G03G 15/2064 |

FOREIGN PATENT DOCUMENTS

JP 2006292867 10/2006

* cited by examiner

*Primary Examiner* — Walter L Lindsay, Jr
*Assistant Examiner* — Laura Roth
(74) *Attorney, Agent, or Firm* — JCIPRNET

(57) ABSTRACT

A fixing device includes a hollow rotating body, a pressing member that applies pressure to a recording medium and transports the recording medium in a transport direction along with rotation of the rotating body, a heating member that is in contact with the rotating body while extending in an axial direction perpendicular to the transport direction, and a holding member that holds the heating member. The heating member includes a contact portion and non-contact portions, the contact portion has a first end portion on a downstream side of the contact portion in the transport direction, each non-contact portion has a second end portion on the downstream side in the transport direction, and each second end portion is thicker than the first end portion in a direction perpendicular to the transport and axial directions. The holding member is in contact with the second end portions in the transport direction.

19 Claims, 9 Drawing Sheets

FIXING DEVICE HAVING HEATING MEMBER AND CONTACT PORTION THEREOF AND IMAGE FORMING APPARATUS

CROSS-REFERENCE TO RELATED APPLICATIONS

This application is based on and claims priority under 35 USC 119 from Japanese Patent Application No. 2019-182131 filed Oct. 2, 2019.

BACKGROUND

(i) Technical Field

The present disclosure relates to a fixing device and an image forming apparatus.

(ii) Related Art

Japanese Unexamined Patent Application Publication No. 2006-292867 discloses a fixing device including a heating body, a fixing sleeve that slides along the heating body and a heating-body holding member, which fixes the heating body in place by holding the heating body, and that includes a flexible metal base layer in the form of an endless belt, and a pressing member that forms a nip together with the heating body with the fixing sleeve interposed therebetween. The fixing device performs a fixing operation while a member to be heated is sandwiched and transported between the fixing sleeve and the pressing member at the nip, and the heating body projects toward a sliding surface further than the heating-body holding member does. In the fixing device, the shape of an edge portion of an end surface of a sliding portion that is included in the projecting heating body is R0.2 or greater.

SUMMARY

Aspects of non-limiting embodiments of the present disclosure relate to providing a fixing device and an image forming apparatus configured to include a heating member that comes into contact with a rotating body, which transports a recording medium by rotating, and that includes an end portion having a thickness smaller than the thickness of a center portion thereof in a transport direction and capable of suppressing a deviation in the position of the heating member in the transport direction when the rotating body rotates compared with the case where only the thin end portion is held.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device including a hollow rotating body that rotates about an axis of the rotating body, a pressing member that applies, together with the rotating body, pressure to a recording medium and transports the recording medium in a transport direction along with rotation of the rotating body, a heating member that is disposed in such a manner as to be in contact with an inner surface of the rotating body while extending in an axial direction perpendicular to the transport direction and that heats the rotating body, the heating member including a contact portion at least a portion of which is brought into contact with the inner surface and non-contact portions that are positioned on either side of the contact portion in the axial direction in such a manner as not to be in contact with the rotating body and each of which has a second end portion thicker than a first end portion of the contact portion on a downstream side in the transport direction, and a holding member that holds the heating member by being brought into contact with at least the second end portions in the transport direction.

BRIEF DESCRIPTION OF THE DRAWINGS

An exemplary embodiment of the present disclosure will be described in detail based on the following figures, wherein.

DETAILED DESCRIPTION

An image forming apparatus 10 and a fixing device 30 will now be described as an example of an image forming apparatus according to the exemplary embodiment and an example of a fixing device according to the exemplary embodiment.

[Overall Configuration]

Figure 1:
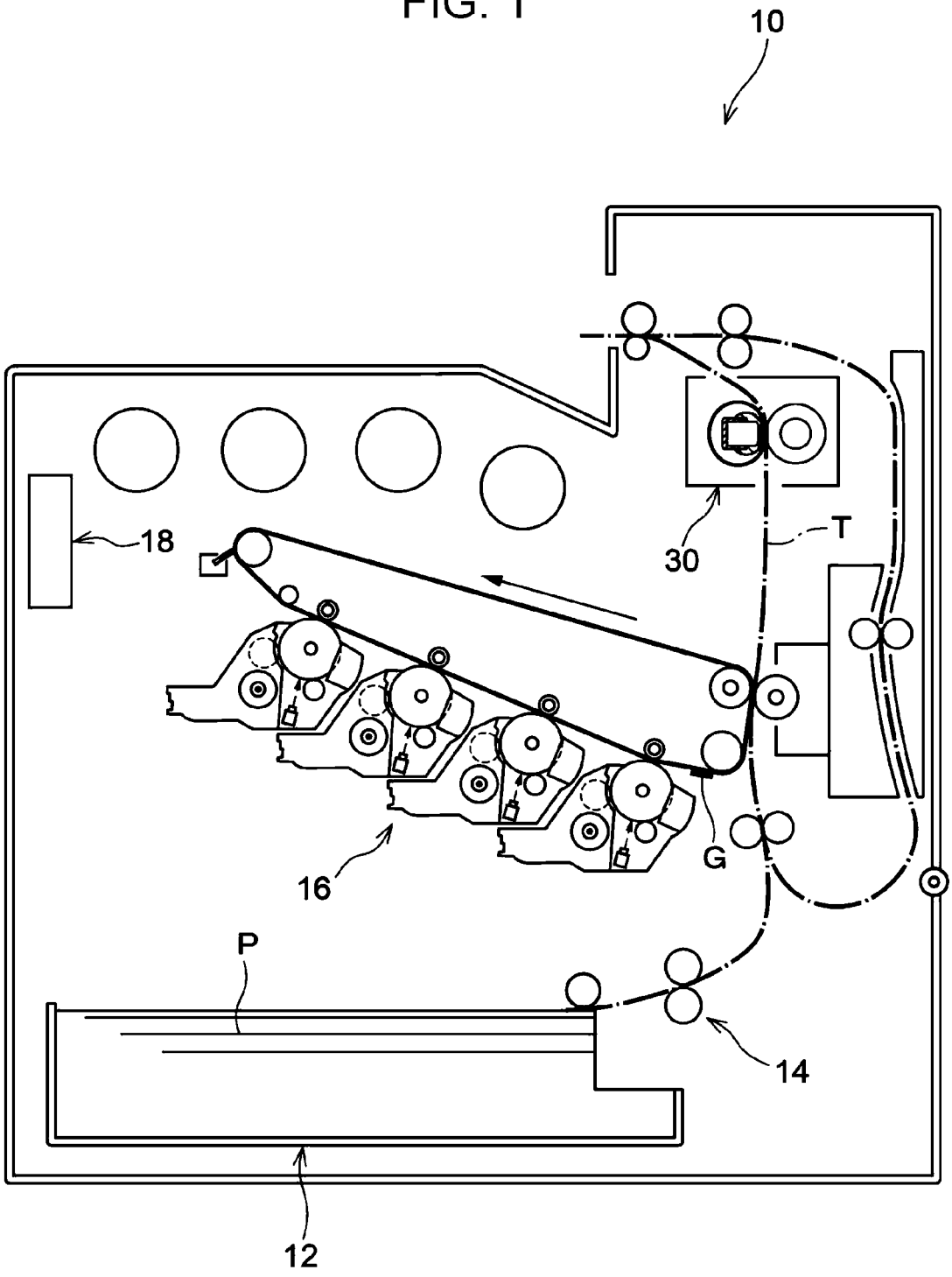
FIG. 1 is a front view of an image forming apparatus according to the exemplary embodiment.

FIG. 1 illustrates the image forming apparatus 10. The image forming apparatus 10 includes an accommodating unit 12 that accommodates sheets P, a transport unit 14 that transports the sheets P, an image forming unit 16 that forms a toner image G onto one of the sheets P, a controller 18 that controls the operation of each unit of the image forming apparatus 10, and the fixing device 30. In the following direction, a height direction, a depth direction, and a transverse direction of the image forming apparatus 10 will hereinafter be referred to as an "apparatus height direction", an "apparatus depth direction", and an "apparatus width direction", respectively. The apparatus height direction, the apparatus depth direction, and the apparatus width direction are directions that are perpendicular to one another.

Each of the sheets P is an example of a recording medium. The toner image G is an example of a developer image. The transport unit 14 transports the sheets P from the accommodating unit 12 upward in the apparatus height direction along a transport path T. The image forming unit 16 is an example of an image forming unit. In addition, as an example, the image forming unit 16 performs charging, light exposure, development, and transfer processes that are included in a commonly known electrophotographic system by using a monochromatic color toner or a plurality of colors of toners so as to form the toner image G onto one of the sheets P.

[Configuration of Principal Portion]

The fixing device 30 will now be described.

Figure 2:
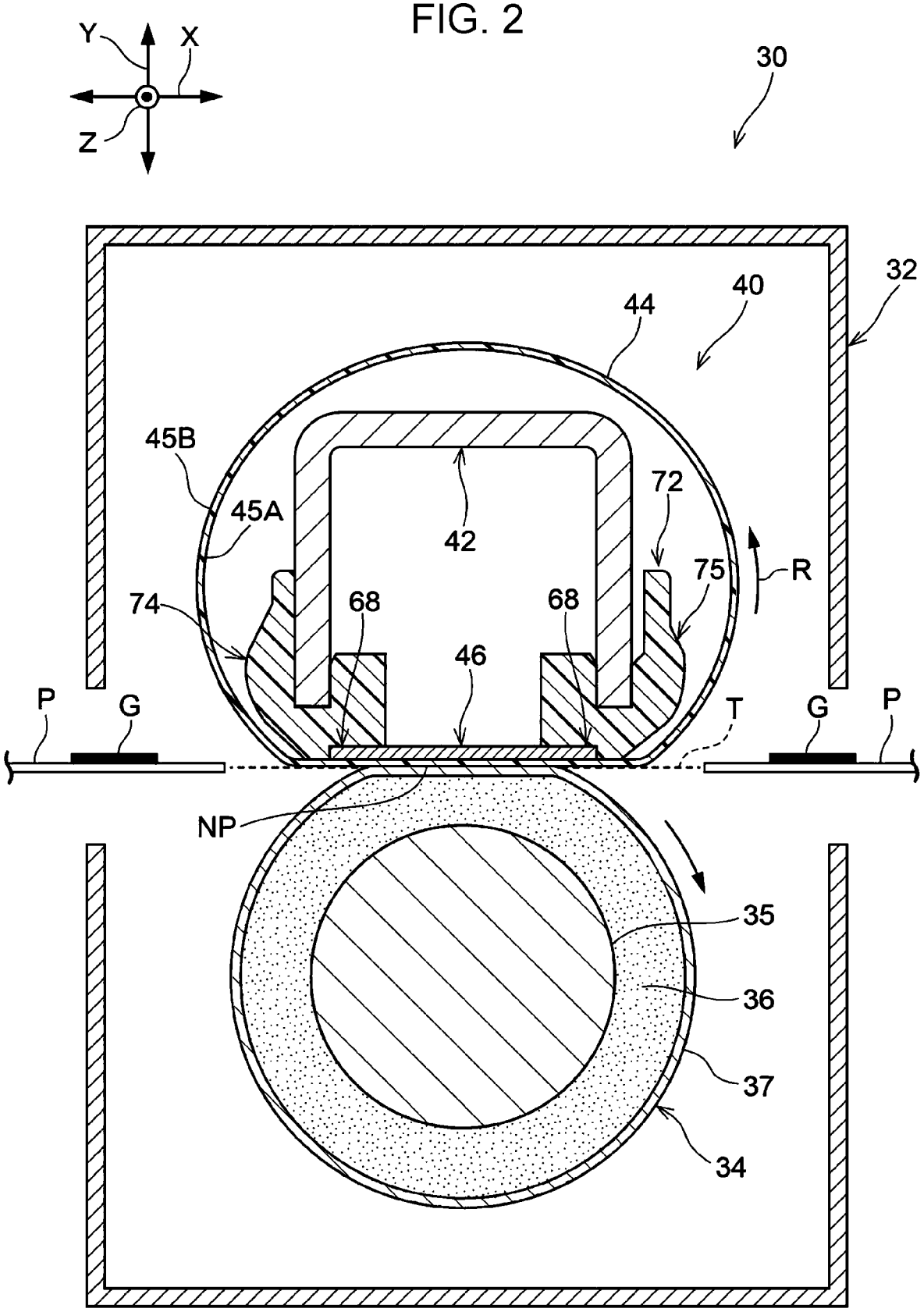
FIG. 2 is a longitudinal sectional view of a fixing device according to the exemplary embodiment.

The fixing device 30 illustrated in FIG. 2 includes a housing 32 that serves as a device body, a heating unit 40 that is disposed in the housing 32 so as to be located on one side of the transport path T, along which the sheets P are to be transported, and a pressure roller 34 that is disposed in the housing 32 so as to be located on the other side of the transport path T. As an example, a direction in which the transport path T extends (a transport direction of the sheets P) is parallel to the apparatus height direction. The fixing device 30 employs, as an example of a transport system for the sheets P, a center registration system in which each of the sheets P is transported by aligning the center of the transport path T and the center of each of the sheets P in the apparatus depth direction. The fixing device 30 fixes the toner image G onto one of the sheets P by applying heat and pressure to the toner image G.

<Pressure Roller>

The pressure roller 34 is an example of a pressing member and includes a shaft member 35 whose axial direction is parallel to the apparatus depth direction, an elastic layer 36, and a release layer 37. The shaft member 35 is supported by a bearing, which is not illustrated, and is made to rotate by a motor, which is not illustrated. In addition, the shaft member 35 is pressed toward the heating unit 40, which is located on the one side of the transport path T, by a pressing member that includes a spring (not illustrated). The pressure roller 34 applies, together with a belt 44 (described later), pressure to one of the sheets P and transports the sheet P in the transport direction along with rotation of the belt 44.

<Heating Unit>

As an example, the heating unit 40 includes a support frame 42, the belt 44, a heater 46, a holding member 72, and a temperature sensing unit (not illustrated). Note that a portion where the outer surface of the belt 44 and the outer peripheral surface of the pressure roller 34 are in contact with each other in a state where any of the sheets P is not passing between the belt 44 and the pressure roller 34 will be referred to as a nip part NP. The temperature sensing unit includes a thermistor and a thermostat, which are not illustrated in the drawings, and is used for controlling a fixing temperature at the nip part NP and for suppressing an excessive rise in temperature.

(Support Frame)

The support frame 42 is a member that is long in the apparatus depth direction. When viewed in the apparatus depth direction, the cross-sectional shape of the support frame 42 is a U-shape that is open toward the pressure roller 34. In addition, in the apparatus depth direction, the two end portions of the support frame 42 are supported by side plates (not illustrated) of the housing 32, and a center portion of the support frame 42 is positioned in a space enclosed by the belt 44, which will be described later.

In the following description, the axial direction of the support frame 42 and the axial direction of the belt 44 (the longitudinal direction) will be referred to as a Z-axis direction. In addition, the transport direction that is perpendicular to the Z-axis direction and in which the sheets P are transported within the fixing device 30 will be referred to as an X-axis direction. Furthermore, a direction that is perpendicular to the X-axis direction and the Z-axis direction and that is a thickness direction of the heater 46 (described later) will be referred to as a Y-axis direction. In the exemplary embodiment, as an example, the Z-axis direction, the X-axis direction, and the Y-axis direction are respectively parallel to the apparatus depth direction, the apparatus height direction, and the apparatus width direction.

In the case of distinguishing positive and negative direction components of the X-axis direction, they will be referred to as an upper side and a lower side since the X-axis direction corresponds to the apparatus height direction. In the case of distinguishing positive and negative direction components of the Y-axis direction, they will be referred to as a heating side and a pressing side. In the case of distinguishing positive and negative direction components of the Z-axis direction, they will be referred to as a far side and a near side since the Z-axis direction corresponds to the apparatus depth direction.

(Belt)

The belt 44 is an example of a hollow rotating body that rotates about its own axis and is formed in a cylindrical shape (an endless loop shape). The inner surface of the belt 44 in the thickness direction will be referred to as an inner peripheral surface 45A. The outer surface of the belt 44 in the thickness direction will be referred to as an outer peripheral surface 45B. The axial direction of the belt 44 is parallel to the Z-axis direction.

In addition, as an example, the belt 44 is a member made of a polyimide resin, and the outer peripheral surface 45B of the belt 44 is coated with fluorine. The two end portions of the belt 44 in the Z-axis direction are each rotatably supported by a cap member (not illustrated). In addition, the belt 44 rotates in the direction of arrow R in FIG. 2 along with rotation of the pressure roller 34 (is driven by the pressure roller 34 and rotates in the direction of arrow R in FIG. 2) so as to transport the sheets P in the X-axis direction.

Figure 3:
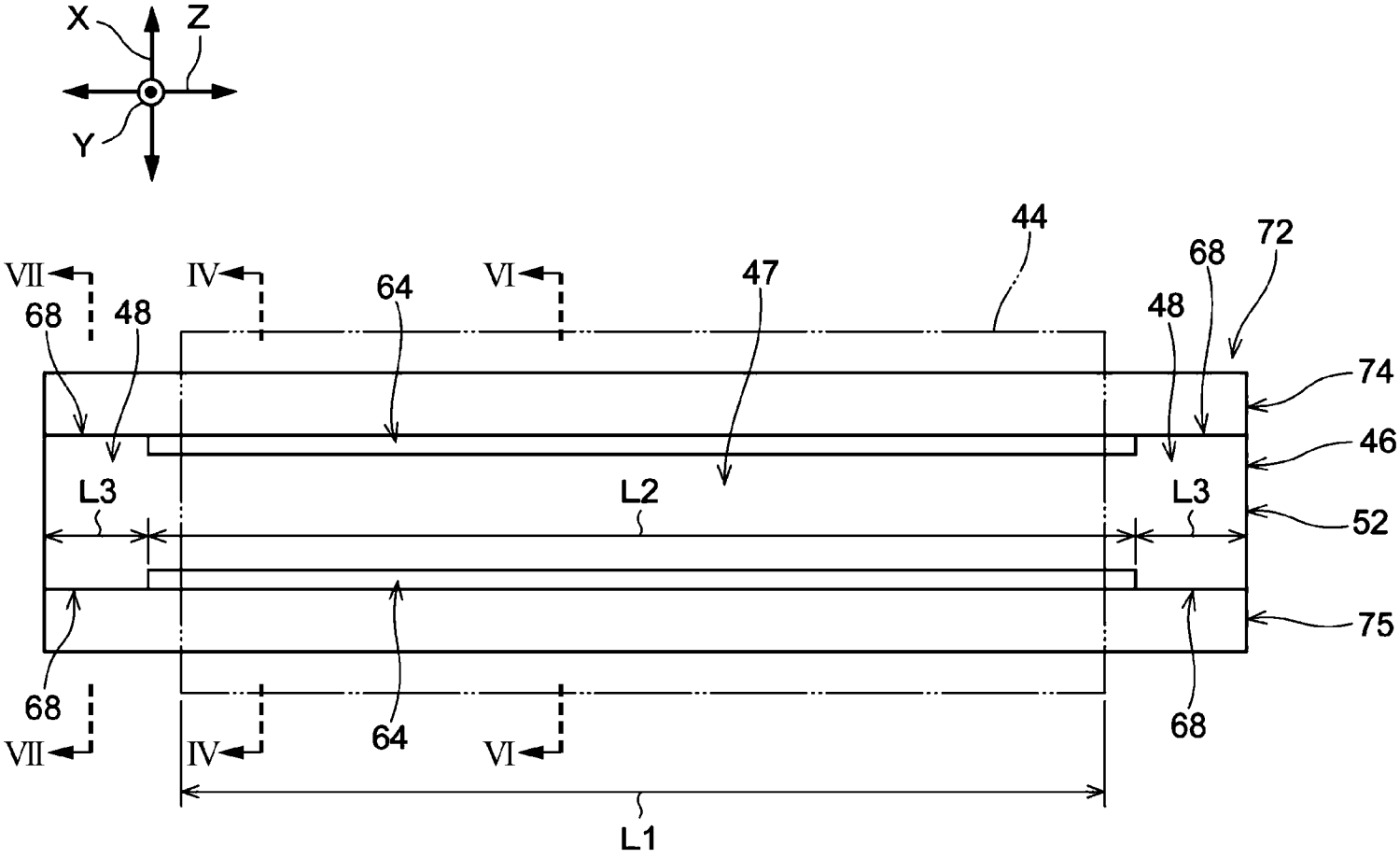
FIG. 3 is a bottom view illustrating a belt, a heating member, and a holding member according to the exemplary embodiment when viewed from a nip part.

As illustrated in FIG. 3, the belt 44 has a length L1 (mm) in the Z-axis direction. The length L1 is longer than the length of the sheet P in the Z-axis direction, the sheet P having a maximum size among the sheets P that are used in the image forming apparatus 10 (see FIG. 1).

(Heater)

The heater 46 illustrated in FIG. 2 is an example of a heating member. The heater 46 is disposed in such a manner as to be in contact with the inner peripheral surface 45A and extend in the Z-axis direction, which is perpendicular to the X-axis direction and the Y-axis direction. In addition, the heater 46 generates heat by being energized by a power supply (not illustrated) and heats the belt 44.

As illustrated in FIG. 3, the heater 46 is formed in a rectangular plate-like shape that is long in the Z-axis direction and short in the X-axis direction. The heater 46 includes a contact portion 47 forming a center portion of the heater 46 in the Z-axis direction and two non-contact portions 48 that are positioned on either side of the contact portion 47 in the Z-axis direction. The contact portion 47 and each of the non-contact portions 48 are distinguished by possession of first end portions 64, which will be described later. The contact portion 47 has a length L2 (mm) in the Z-axis direction. The length L2 is longer than the above-mentioned length L1. One of the non-contact portions 48 has a length L3 (mm) in the Z-axis direction. As an example, the length L3 is one-twelfth or more and one-eighth or less of the length L2. A portion of the contact portion 47, excluding the two end portions in the Z-axis direction, comes into contact with the inner peripheral surface 45A (see FIG. 2). The non-contact portions 48 do not come into contact with the belt 44.

Figure 4:
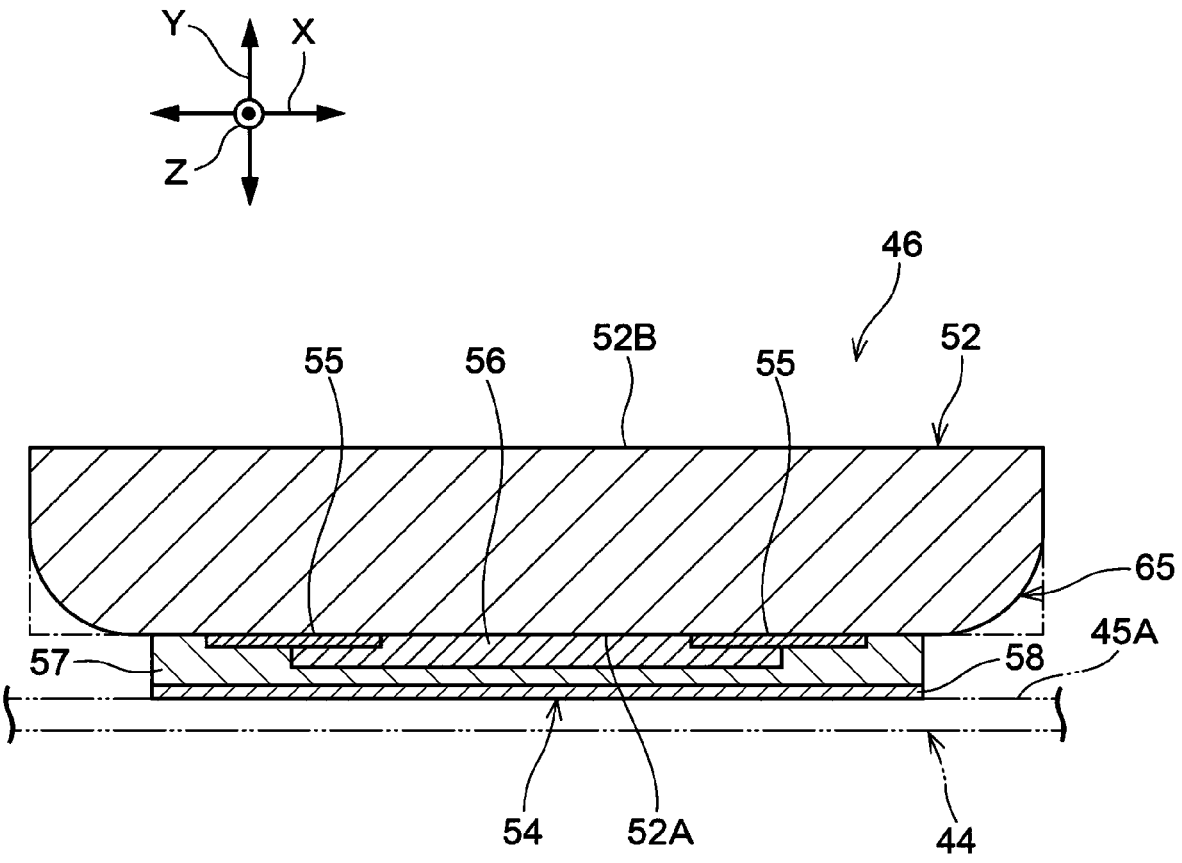
FIG. 4 is a longitudinal sectional view (a cross-sectional view taken along line IV-IV of FIG. 3) of a heater according to the exemplary embodiment.

FIG. 4 is a longitudinal sectional view (a view of an X-Y cross section) of the heater 46. As an example, when viewed in the Z-axis direction, the heater 46 includes a base plate 52 and a heat-generating portion 54 that is used for heating the belt 44. Note that, in FIG. 4, the heat-generating portion 54 is illustrated in an enlarged manner with respect to the base plate 52 in order to clearly illustrate the configuration of the heat-generating portion 54. In practice, however, the thickness of the heat-generating portion 54 in the Y-axis direction is smaller than the thickness of the base plate 52 in the Y-axis direction. Accordingly, in the drawings excluding FIG. 4, the heater 46 is illustrated in a plate-like shape by considering the external shape of the heater 46 to be substantially the same as the external shape of the base plate 52.

The base plate 52 is formed of a rectangular plate that is long in the Z-axis direction and short in the X-axis direction. As an example, the base plate 52 is formed of an alumina compact. As an example, the thickness of the base plate 52 in the Y-axis direction is about 1 mm. A surface of the base plate 52 on the pressing side in the Y-axis direction will be referred to as a front surface 52A, and a surface of the base plate 52 on the heating side will be referred to as a rear surface 52B. As an example, the base plate 52 is one of a plurality of pieces obtained by cutting a large plate member made of alumina.

Figure 5:
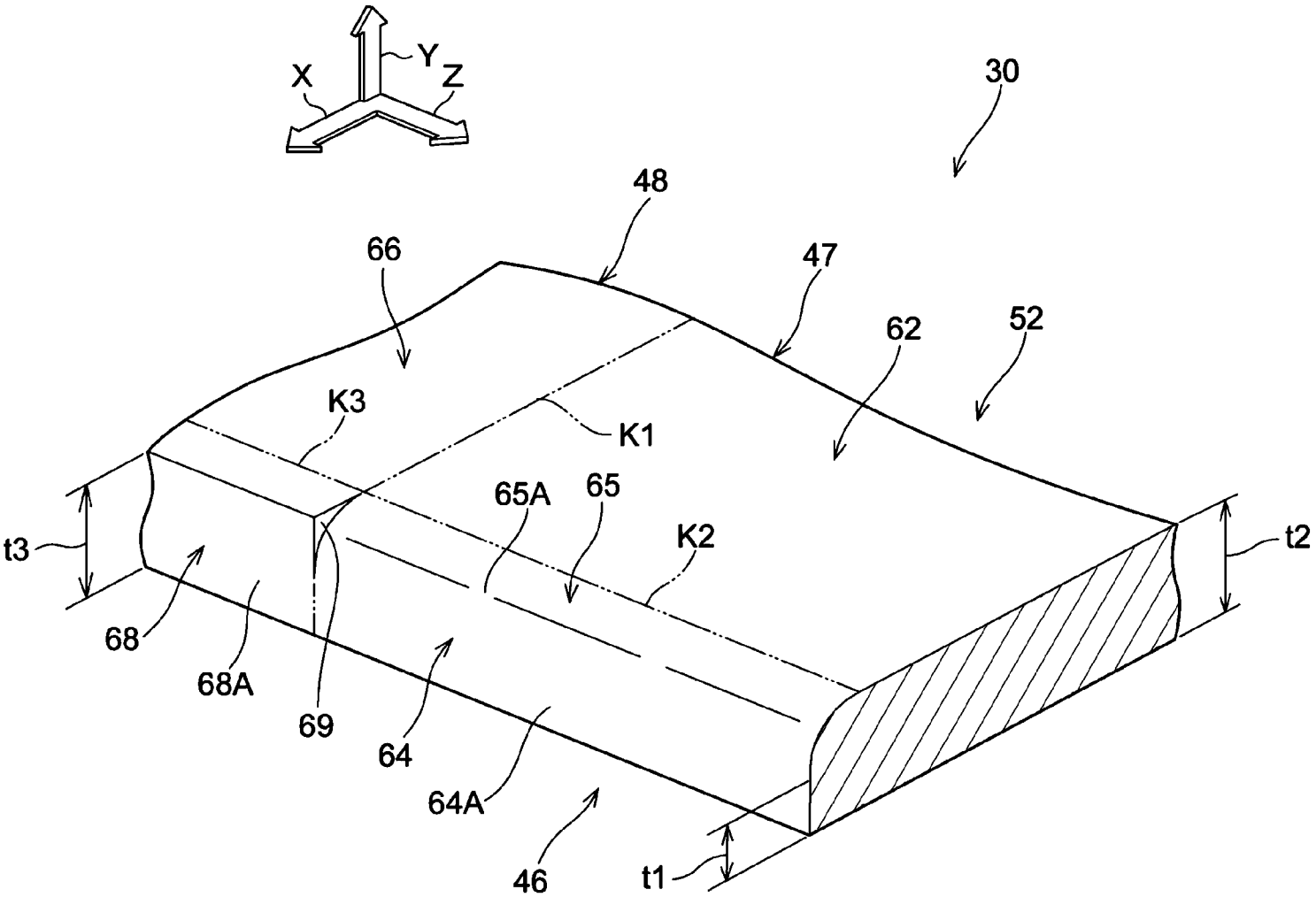
FIG. 5 is a partial perspective view illustrating a portion of the heating member according to the exemplary embodiment.

FIG. 5 illustrates a portion of the base plate 52 at the boundary between the contact portion 47 and one of the non-contact portions 48. Note that an imaginary (invisible) boundary K1 between the contact portion 47 and the non-contact portion 48 is indicated by a two-dot chain line. The heat-generating portion 54 (see FIG. 4) is not illustrated in FIG. 5.

The contact portion 47 includes a base portion 62 and the first end portions 64, and the base portion 62 and the first end portions 64 are arranged in the X-axis direction. An imaginary (invisible) boundary K2 between the base portion 62 and one of the first end portions 64 is indicated by a two-dot chain line. Note that the boundary K2 is a boundary defined by connecting imaginary points to one another in the Z-axis direction, the imaginary points each representing a starting point for a chamfered portion 65 (described later) in the X-axis direction in the X-Y cross section. As an example, the first end portions 64 are formed on the upper side (a downstream side) and the lower side (an upstream side) of the contact portion 47 in the X-axis direction. In other words, the base portion 62 is a portion of the contact portion 47 excluding the first end portions 64 and is a plate-shaped portion having an approximately uniform thickness in the X-axis direction and the Z-axis direction. Note that FIG. 5 illustrates a portion of the base portion 62 and one of the first end portions 64 that is located on the upper side in the X-axis direction.

A portion of the first end portion 64 is formed as the chamfered portion 65 when viewed in the Z-axis direction. As an example, the chamfered portion 65 is a portion of the first end portion 64, the portion being located further toward the pressing side in the Y-axis direction than a center portion of the first end portion 64 is. In addition, as an example, the chamfered portion 65 is an R-chamfered portion. In other words, the chamfered portion 65 is formed to have an arc shape when viewed in the Z-axis direction. As an example, the length of each of the first end portions 64 that corresponds to the width of the first end portion 64 in the X-axis direction is set to a length that corresponds to the radius of the arc-shaped portion. Here, an end surface of the first end portion 64 in the X-axis direction (a surface of the first end portion 64 that is located further toward the heating side in the Y-axis direction than the center portion of the first end portions 64 is) will be referred to as a side surface 64A, and the surface of the arc-shaped portion of the chamfered portion 65 will be referred to as a curved surface 65A. The side surface 64A extends along a Y-Z plane. The curved surface 65A is formed in such a manner as to be continuous with the side surface 64A. In addition, the curved surface 65A bulges outward when viewed in the Z-axis direction.

When the side surface 64A has a thickness (height) t1 (mm) in the Y-axis direction, and the base portion 62 has a thickness t2 (mm) in the Y-axis direction, a relationship of $t<t2$ is satisfied. As an example, the thickness t1 is set to be one third or more and two-thirds or less of the thickness t2.

Each of the non-contact portions 48 includes a base portion 66 and second end portions 68. In FIG. 5, an imaginary (invisible) boundary K3 between the base portion 66 and one of the second end portions 68 is indicated by a two-dot chain line. As an example, the boundary K2 and the boundary K3 are positioned on the same straight line extending in the Z-axis direction. As an example, the second end portions 68 are formed on the upper side (the downstream side) and the lower side (the upstream side) of the non-contact portion 48 in the X-axis direction. In other words, the base portion 66 is a portion of the non-contact portion 48 excluding the second end portions 68 and is a plate-shaped portion having an approximately uniform thickness in the X-axis direction and the Z-axis direction. Note that FIG. 5 illustrates a portion of the base portion 66 and one of the second end portions 68 that is located on the upper side in the X-axis direction.

A portion of the second end portion 68 (a portion of the second end portion 68 that is located further toward the pressing side in the Y-axis direction than the center portion of the second end portion 68 is) is formed in a rectangular shape when viewed in the Z-axis direction. The base portion 66 has the thickness t2 (mm) in the Y-axis direction. A surface of the base portion 66 that is located on the pressing side in the Y-axis direction and a surface of the base portion 62 on the pressing side in the Y-axis direction are aligned on the same plane. In addition, a side surface 68A that is an end surface of the second end portions 68 in the X-axis direction and the side surface 64A are aligned on the same plane that is the Y-Z plane.

When the second end portion 68 has a thickness t3 (mm) in the Y-axis direction, a relationship of $t3=t2$ is satisfied. In other words, the non-contact portion 48 includes the second end portion 68 that is located on the downstream side in the X-axis direction and that has a thickness larger than the thickness of the first end portion 64.

Figure 8:
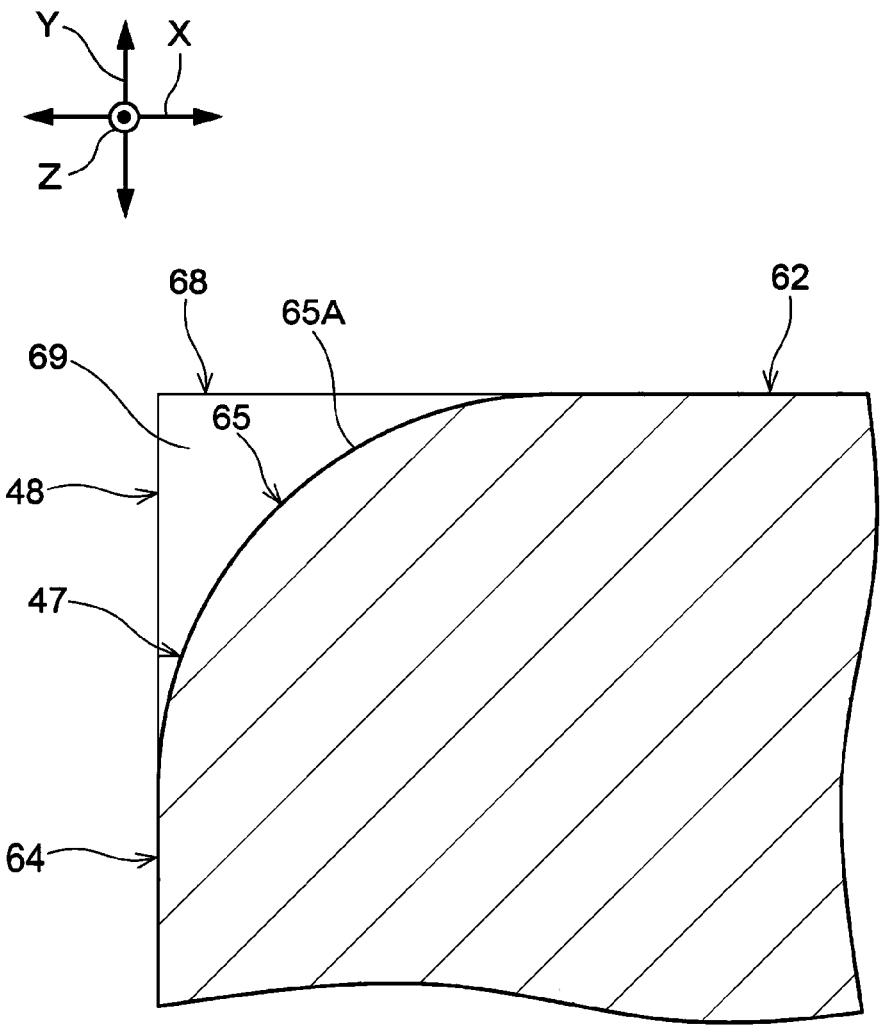
FIG. 8 is a partially enlarged cross-sectional view of the heating member according to the exemplary embodiment.

As illustrated in FIG. 8, a portion of the second end portion 68 projects outward further than the chamfered portion 65 (the curved surface 65A) does when viewed in the Z-axis direction. Here, a surface of the portion of the second end portion 68 projecting outward further than the first end portion 64 does, the surface being positioned at the above-mentioned boundary K1 (see FIG. 5), will be referred to as a side surface 69. The side surface 69 is a flat surface extending along an X-Y plane.

As illustrated in FIG. 4, the heat-generating portion 54 includes, as an example, two resistive elements 55, two electrodes 56 (only one of them is illustrated in FIG. 4), a protective portion 57, and a smoothing portion 58. The entire thickness of the heat-generating portion 54 in the Y-axis direction is about 60 (μm) as an example. The two resistive elements 55 are arranged in such a manner as to be in contact with the front surface 52A of the base plate 52 and in such a manner as to be spaced apart from each other in the X-axis direction. The two resistive elements 55 each extend in the Z-axis direction so as to correspond to the lengths of the sheets P in the Z-axis direction. One of the two electrodes 56 is connected to first end portions of the two resistive elements 55 in the Z-axis direction, and the other of electrodes 56 is connected to second end portions of the two resistive elements 55 in the Z-axis direction.

In the heat-generating portion 54, a power supply (not illustrated) is connected to the two electrodes 56, and the two resistive elements 55 generate heat by being energized by the power source. The protective portion 57 covers the resistive elements 55 and the electrodes 56. The smoothing portion 58 is in contact with the inner peripheral surface 45A. In addition, the smoothing portion 58 is made of a material having a low friction coefficient with respect to the belt 44 so as to reduce the frictional resistance that is generated as a result of the smoothing portion 58 and the belt 44 sliding over each other.

As illustrated in FIG. 2, the thickness direction of the heater 46 is parallel to the Y-axis direction, and the heater 46 is disposed in a space enclosed by the belt 44 and held by the holding member 72, which will be described later. More specifically, the heater 46 is disposed on the heating side in the Y-axis direction with respect to a portion of the belt 44 located at the nip part NP and is in contact with the inner peripheral surface 45A. In this manner, the heater 46 nips the belt 44 and one of the sheets P together with the pressure roller 34 at the nip part NP so as to apply pressure and heat to the belt 44 and the sheet P. Note that the load that acts on the heater 46 at the time of the above pressurization is transmitted to the support frame 42 via the holding member 72. Thus, deformation of the heater 46 is suppressed.

(Holding Member)

As an example, the holding member 72 illustrated in FIG. 2 is a member that is made of a polyimide resin and that is long in the Z-axis direction. The holding member 72 includes an upstream-side holding member 74 that is disposed on the lower side (the upstream side) in the X-axis direction and a downstream-side holding member 75 that is disposed on the upper side (the downstream side) in the X-axis direction.

The upstream-side holding member 74 and the downstream-side holding member 75 are attached to end portions of the support frame 42 that are located on the pressing side. As an example, the upstream-side holding member 74 and the downstream-side holding member 75 hold the heater 46 by being in contact with the first end portions 64 (see FIG. 5) and the second end portions 68 in the X-axis direction. In other words, in the X-axis direction, the holding member 72 is in contact with the second end portions 68, which are located on the upstream side and the downstream side in the X-axis direction. In addition, in the X-axis direction, the holding member 72 is in contact with portions of the first end portions 64 in the thickness direction of the belt 44, that is, the side surfaces 64A.

Here, a portion of the upstream-side holding member 74 that holds the heater 46 and a portion of the downstream-side holding member 75 that holds the heater 46 are formed so as to be substantially symmetric to each other with respect to a center portion of the heater 46 in the X-axis direction. Thus, the downstream-side holding member 75 will now be described, and the description of the upstream-side holding member 74 will be omitted.

Figure 6:
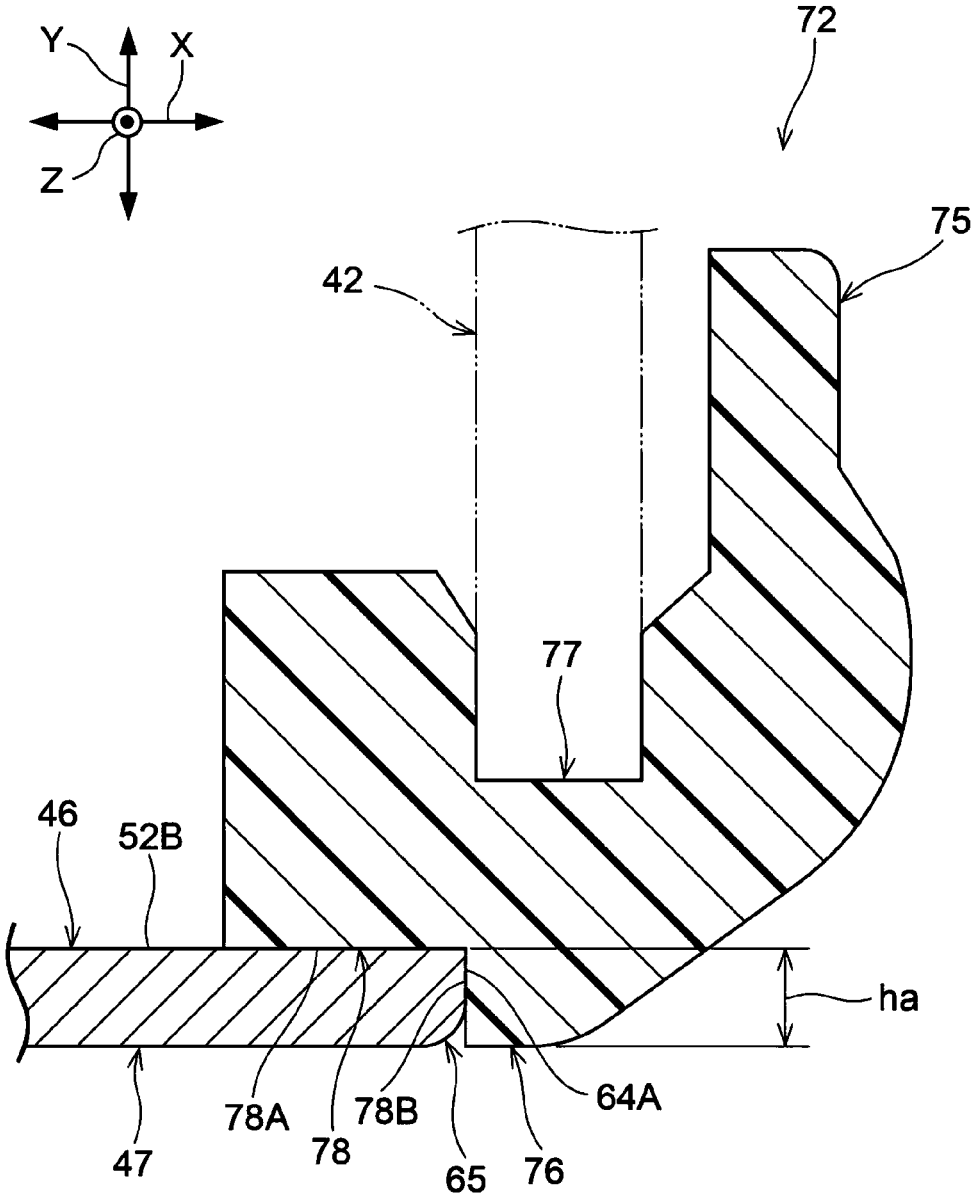
FIG. 6 is a partial cross-sectional view (a partial cross-sectional view taken along line VI-VI of FIG. 3) of the heating member and the holding member according to the exemplary embodiment.

As illustrated in FIG. 6, the portion of the downstream-side holding member 75 that holds the contact portion 47 will be referred to as a first holding portion 76. The first holding portion 76 has a to-be-attached portion 77 and a recess 78. When viewed in the Z-axis direction, the cross section of the to-be-attached portion 77 has a U-shape that is open toward the heating side in the Y-axis direction. In addition, one of the end portions of the support frame 42 is inserted in and fixed (joined) to the to-be-attached portion 77.

When viewed in the Z-axis direction, the recess 78 has a contact surface 78A that extends in the X-axis direction and a contact surface 78B that extends from the downstream end of the contact surface 78A toward the pressing side in the Y-axis direction. In the Y-axis direction, the contact surface 78A is in contact with an end portion of the rear surface 52B of the heater 46, the end portion being located on the downstream side in the X-axis direction. The contact surface 78B is in contact with the side surface 64A of the heater 46 in the X-axis direction. As a result, movements of the contact portion 47 in the X-axis direction and the Y-axis direction are restricted.

Figure 7:
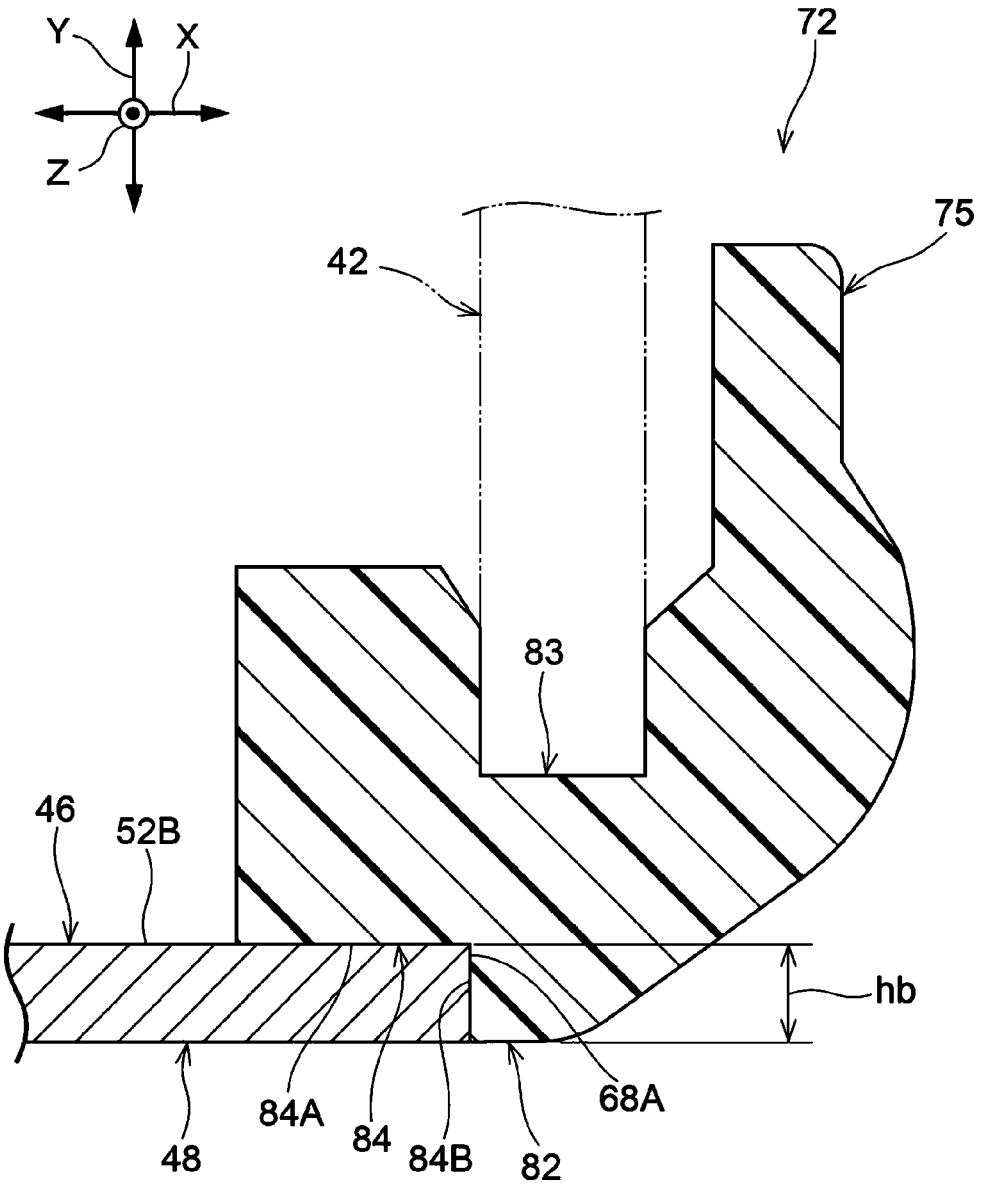
FIG. 7 is a partial cross-sectional view (a partial cross-sectional view taken along line VII-VII of FIG. 3) of the heating member and the holding member according to the exemplary embodiment.

As illustrated in FIG. 7, portions of the downstream-side holding member 75 each of which holds one of the non-contact portions 48 will be referred to as second holding portions 82. Each of the second holding portions 82 has a to-be-attached portion 83 and a recess 84. When viewed in the Z-axis direction, the cross section of the to-be-attached portion 83 has a U-shape that is open toward the heating side in the Y-axis direction. In addition, one of the end portions of the support frame 42 is inserted in and fixed (joined) to the to-be-attached portion 83.

When viewed in the Z-axis direction, the recess 84 has a contact surface 84A that extends in the X-axis direction and a contact surface 84B that extends from the downstream end of the contact surface 84A toward the pressing side in the Y-axis direction. In other words, when viewed in the Z-axis direction, the cross section of the recess 84 has an L-shape. The contact surface 84A is continuous with the above-mentioned contact surface 78A (see FIG. 6) in such a manner that these surfaces are located on the same plane. The contact surface 84B is continuous with the above-mentioned contact surface 78B (see FIG. 6) in such a manner that these surfaces are located on the same plane. In the Y-axis direction, the contact surface 84A is in contact with an end portion of the rear surface 52B of the heater 46, the end portion being located on the downstream side in the X-axis direction. The contact surface 84B is in contact with the side surface 68A of the heater 46 in the X-axis direction. As a result, movements of the non-contact portions 48 in the X-axis direction and the Y-axis direction are restricted.

In FIG. 6 and FIG. 7, a portion that faces one of the first end portions 64 in the X-axis direction has a first height ha in the thickness direction (the Y-axis direction in FIG. 6 and FIG. 7), and a portion that faces one of the second end portions 68 in the X-axis direction has a second height hb in the thickness direction (the Y-axis direction in FIG. 6 and FIG. 7). The first height ha and the second height hb are the same as each other.

A heat-resistant resin member (not illustrated) is provided at the two ends of the upstream-side holding member (see FIG. 2) and the two ends of the downstream-side holding member 75 in the Z-axis direction. Movement of the heater 46 in the Z-axis direction is restricted by these heat-resistant resin members. In addition, the upstream-side holding member 74 and the downstream-side holding member 75 are integrally provided as a result of the heat-resistant resin members being interposed therebetween. Note that the heater 46 is not bonded to the holding member 72 in the X-axis direction, the Y-axis direction, or the Z-axis direction.

[Effects]

Effects of the fixing device 30 and the image forming apparatus 10 according to the present exemplary embodiment will now be described.

In the fixing device 30 illustrated in FIG. 2, the heater 46 generates heat by being energized, and as a result, the belt 44 is heated. Then, one of the sheets P on which the toner image G has been formed enters the space between the belt 44 and the pressure roller 34 (i.e., the nip part NP), so that the toner image G is heated and pressurized, and the toner image G is fixed onto the sheet P. The sheet P to which the toner image G has been fixed is ejected from the nip part NP along with rotations of the pressure roller 34 and the belt 44.

When the belt 44 and the pressure roller 34 transport the sheet P while applying pressure to the sheet P, a force acts on the contact portion 47 (see FIG. 3) of the heater 46 to try to move the contact portion 47 toward the downstream side in the X-axis direction.

Here, the second end portions 68 of the non-contact portions 48, each of which is thicker than each of the first end portions 64 of the contact portion 47 illustrated in FIG. 3, are held in place by being in contact with the holding member 72 in the X-axis direction. In other words, movement of the heater 46 in the X-axis direction is restricted by contact between the second end portions 68 of the heater 46, which are thick, and the holding member 72. As a result, compared with the case of holding a heater having a cross-sectional shape that is the same as that of the contact portion 47 over the entire length thereof, the deviation in the position of the heater 46 in the X-axis direction when the belt 44 is rotated is suppressed.

According to the fixing device 30, the holding member 72 is provided not only on the downstream side in the X-axis direction but also on the upstream side in the X-axis direction. Thus, for example, in the case where the operation of the fixing device 30 is stopped in a state where one of the sheets P is nipped at the nip part NP, and the sheet P is pulled out toward the upstream side in the X-axis direction, movement of the heater 46 toward the upstream side in the X-axis direction is restricted by contact between the second end portions 68 and the holding member 72. As described above, in the case where one of the sheets P is pulled out toward the upstream side in the X-axis direction, each of the second end portions 68 and the holding member 72 come into contact with each other, and thus, a deviation in the position of the heater 46 is suppressed compared with the case in which the holding member 72 is provided only on the downstream side in the X-axis direction.

According to the fixing device 30, each of the first end portions 64 has the chamfered portion 65, which is formed in an arc shape, as a portion thereof. As a result, compared with the case in which the heater 46 has a step portion when viewed in the Z-axis direction, the belt 44, which is moving, is less likely to become caught on a portion of the heater 46, so that the degree of wear of the belt 44 due to contact between the belt 44 and the first end portions 64 is reduced. In addition, since a portion of each of the first end portions 64 has an arc shape, in a case where a plurality of base plates 52 are obtained from a single plate member, a boundary portion between each two of the base plates 52 that are adjacent to each other is formed in a groove shape. This facilitates cutting and obtaining the plurality of base plates 52 compared with the case in which no arc-shaped portion is formed.

According to the fixing device 30, a portion of each of the second end portions 68 projects outward further than each of the first end portions 64 does when viewed in the Z-axis direction. As a result, the limitation on the arrangement of the second end portions 68 because of the arrangement of the first end portions 64 is reduced, and thus, the thickness of each of the second end portions 68 may be increased within the range of the thickness of the portion (the base portion 62) of the contact portion 47 excluding the first end portions 64.

According to the fixing device 30, in addition to the second end portions 68, the first end portions 64 come into contact with the holding member 72. As a result, compared with the case in which the holding member 72 is not in contact with the first end portions 64, the range of movement of the heater 46 in the X-axis direction to be restricted expands in the Z-axis direction, and thus, the displacement of the heater 46 in the X-axis direction is suppressed.

According to the fixing device 30, the first height ha (see FIG. 6) and the second height hb (see FIG. 7) of the holding member 72 are the same as each other. Thus, when the entire first end portions 64 are deformed in the X-axis direction, even if the heightwise positions of the first end portions 64 are displaced in the Y-axis direction, the portions each having the first height ha, which is the same as the second height hb, restrict the movements of the first end portions 64. As a result, compared with the case in which the first height ha is smaller than the second height hb, deformation of each of the first end portions 64 is suppressed.

According to the image forming apparatus 10 illustrated in FIG. 1, providing the fixing device 30 suppresses a deviation in the position of the heater 46 in the X-axis direction. As a result, compared with the case in which displacement of the contact portion 47 of the heater 46 is not controlled, the temperature distribution in the toner image G, which is heated, in the X-axis direction is less likely to fluctuate, and thus, occurrence of an image defect due to displacement of the heater 46 in the X-axis direction is suppressed. Examples of an image defect include a phenomenon in which a portion of an image is missed when hot offset occurs and a phenomenon in which an image becomes contaminated when hot offset occurs.

In the fixing device 30 illustrated in FIG. 2, the heater 46 has the side surfaces 69 (see FIG. 5 or FIG. 8). Here, when the belt 44 tries to move toward the near side or the far side in the Z-axis direction, movement of the belt 44 in the Z-axis direction is restricted as a result of the end surface of the belt 44 in the Z-axis direction coming into contact with the side surfaces 69, so that deviation of the belt 44 is suppressed.

Note that the present disclosure is not limited to the above-described exemplary embodiment.

<Modification>

Figure 9:
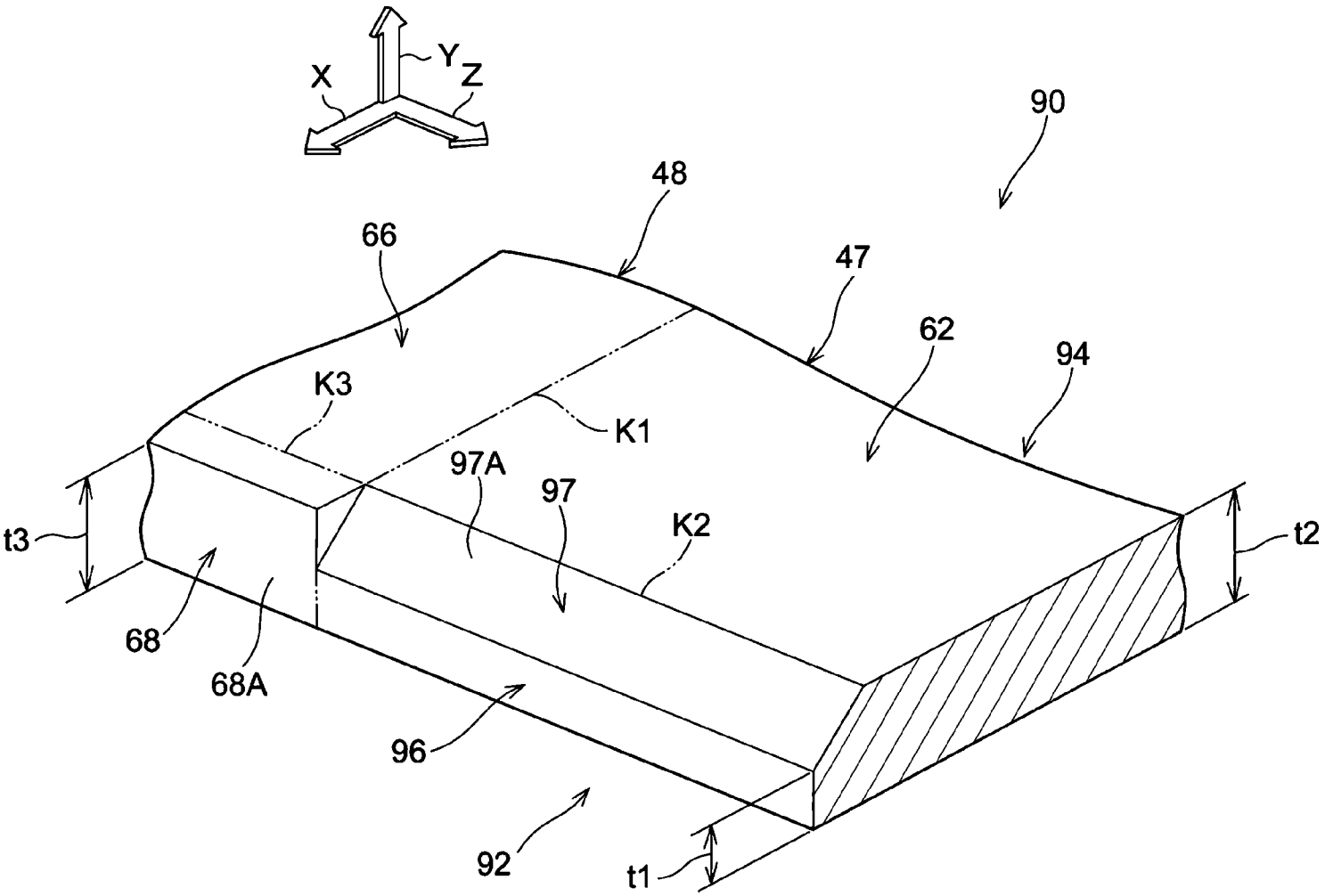
FIG. 9 is a partial perspective view illustrating a portion of a heating member according to a modification of the exemplary embodiment.

FIG. 9 illustrates a heater 92 included in a fixing device 90 that is a modification of the fixing device 30 (see FIG. 2). Note that, the configuration of the fixing device 90, excluding the heater 92 (described later), is similar to that of the fixing device 30, and thus, the description there of will be omitted.

The heater 92 is an example of a heating member. The difference between the heater 92 and the heater 46 (see FIG. 4) is that the heater 92 includes a base plate 94 instead of the base plate 52 (see FIG. 4). The configuration of the heater 92, excluding the base plate 94, is similar to that of the heater 46, and thus, the description there of will be omitted.

The difference between the base plate 94 and the base plate 52 is that the base plate 94 includes first end portions 96 instead of the arc-shaped first end portions 64 (see FIG. 5). The configuration of the base plate 94, excluding the first end portions 96, is similar to that of the base plate 52. A portion of each of the first end portions 96 is formed as a chamfered portion 97 when viewed in the Z-axis direction.

As an example, the chamfered portion 97 is a portion of each of the first end portions 96 that is located further toward the pressing side in the Y-axis direction than a center portion of the first end portion 96 is. As an example, the chamfered portion 97 is a C-chamfered portion. In other words, the chamfered portion 97 is formed in an obliquely cut shape (a shape having an inclined surface 97A) when viewed in the Z-axis direction. When viewed in the Z-axis direction, the inclined surface 97A is inclined in a direction crossing the X-axis direction. More specifically, when viewed in the Z-axis direction, the inclined surface 97A is inclined in a direction in which the thickness of an end portion of the first end portion 96 in the X-axis direction is smaller than the thickness of a portion of the first end portion 96, the portion being adjacent to the base portion 62 in the X-axis direction. As described above, each of the first end portions is not limited to having an arc-shaped portion and may have the inclined surface 97A. Note that a portion of each of the second end portions 68 projects outward further than a corresponding one of the chamfered portions 97 (the inclined surface 97A) does when viewed in the Z-axis direction.

<Another Modification>

In the fixing device 30, the heater 46 may include only one of the first end portions 64 that is formed on the downstream side in the X-axis direction. Similarly, the heater 46 may include only one of the second end portions 68 that is formed on the downstream side in the X-axis direction. When viewed in the Z-axis direction, a portion of each of the second end portions 68 does not need to project outward further than the corresponding first end portion 64 does. For example, each of the second end portions 68 may be located on the side on which a corresponding one of the base portions 66 is present, so that each of the second end portions 68 does not need to project outward further than the corresponding first end portion 64 does.

The holding member 72 may be configured not to come into contact with the first end portions 64 or 96 in the X-axis direction and may be configured to come into contact only with the second end portions 68. The first height ha and the second height hb of the holding member 72 may be different from each other. For example, the first height ha may be equal to the thickness t1, and the second height hb may be equal to the thickness t3.

The heater 46 may project toward the pressing side (the side on which one of the sheets P is to be present) further than the holding member 72 does. When viewed in the Y-axis direction, the external shape of each of the non-contact portions 48 of the heater 46 is not limited to a rectangular shape and may be a trapezoidal shape, a quadrangular shape or a polygonal shape with five or more vertices. The entire contact portion 47 of the heater 46 may come into contact with the inner peripheral surface 45A.

The heater 46 and the holding member 72 are not limited to being arranged at the position at which the nip part NP is formed and may be arranged upstream from the position at which the nip part NP is formed in the direction of rotation of the belt 44.

Although the present disclosure has been described by using an image forming apparatus that employs an electrophotographic system, the present disclosure is not limited to an image forming apparatus that employs an electrophotographic system and may be applied to, for example, an image forming apparatus that employs an ink-jet system and that fixes an undried ink image (an unfixed ink image) onto a sheet by coming into contact with the sheet, which is transported while holding the unfixed ink image.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing device comprising:

a hollow rotating body that rotates about an axis of the rotating body;

a pressing member that applies, together with the rotating body, pressure to a recording medium and transports the recording medium in a transport direction along with rotation of the rotating body;

a heating member that is disposed to be in contact with an inner surface of the rotating body while extending in an axial direction perpendicular to the transport direction and that heats the rotating body, the heating member including a contact portion and two non-contact portions, wherein a center portion of the contact portion in the axial direction is in contact with the inner surface of the rotating body, the two non-contact portions are respectively disposed on two ends of the contact portion in the axial direction and are not in contact with the rotating body, the contact portion has a downstream-side first end portion on a downstream side of the contact portion in the transport direction, each of the two non-contact portions has a downstream-side second end portion on the downstream side in the transport direction, and each downstream-side second end portion is thicker than the downstream-side first end portion in a thickness direction perpendicular to the transport direction and the axial direction; and a holding member that holds the heating member by being brought into contact with at least the downstream-side second end portions in the transport direction.

2. The fixing device according to claim 1, wherein the contact portion has an upstream-side first end portion on an upstream side of the contact portion in the transport direction, wherein each of the two non-contact portions has an upstream-side second end portion on the upstream side in the transport direction, and wherein, in the transport direction, the holding member is in contact with the upstream-side and downstream-side second end portions.

3. The fixing device according to claim 2, wherein a portion of each of the upstream-side and downstream-side first end portions is formed as a chamfered portion when viewed in the axial direction.

4. The fixing device according to claim 3, wherein a portion of each of the upstream-side and downstream-side second end portions projects outward further than a corresponding one of the chamfered portions does when viewed in the axial direction.

5. The fixing device according to claim 4, wherein, in the transport direction, the holding member is in contact with a portion of each of the upstream-side and downstream-side first end portions in the thickness direction.

6. The fixing device according to claim 5, wherein portions of the holding member, the portions facing the upstream-side and downstream-side first end portions in the transport direction, each have a first height in the thickness direction, and portions of the holding member, the portions facing the downstream-side second end portions in the transport direction, each have a second height in the thickness direction that is the same as the first height.

7. The fixing device according to claim 3, wherein, in the transport direction, the holding member is in contact with a portion of the downstream-side first end portion in the thickness direction.

8. The fixing device according to claim 7, wherein a portion of the holding member, the portion facing the downstream-side first end portion in the transport direction, has a first height in the thickness direction, and portions of the holding member, the portions facing the downstream-side second end portions in the transport direction, each have a second height in the thickness direction that is the same as the first height.

9. The fixing device according to claim 2, wherein, in the transport direction, the holding member is in contact with a portion of the downstream-side first end portion in the thickness direction.

10. The fixing device according to claim 9, wherein a portion of the holding member, the portion facing the downstream-side first end portion in the transport direction, has a first height in the thickness direction, and portions of the holding member, the portions facing the downstream-side second end portions in the transport direction, each have a second height in the thickness direction that is the same as the first height.

11. The fixing device according to claim 2, wherein, in the transport direction, the holding member is in contact with a portion of each of the upstream-side and downstream-side first end portions in the thickness direction.

12. The fixing device according to claim 11, wherein portions of the holding member, the portions facing the upstream-side and downstream-side first end portions in the transport direction, each have a first height in the thickness direction, and portions of the holding member, the portions facing the downstream-side second end portions in the transport direction, each have a second height in the thickness direction that is the same as the first height.

13. The fixing device according to claim 1, wherein a portion of the downstream-side first end portion is formed as a chamfered portion when viewed in the axial direction.

14. The fixing device according to claim 13, wherein a portion of each of the downstream-side second end portions projects outward further than the chamfered portion does when viewed in the axial direction.

15. The fixing device according to claim 14, wherein, in the transport direction, the holding member is in contact with a portion of the downstream-side first end portion in the thickness direction.

16. The fixing device according to claim 15, wherein a portion of the holding member, the portion facing the downstream-side first end portion in the transport direction, has a first height in the thickness direction, and portions of the holding member, the portions facing the downstream-side second end portions in the transport direction, each have a second height in the thickness direction that is the same as the first height.

17. The fixing device according to claim 1, wherein, in the transport direction, the holding member is in contact with a portion of the downstream-side first end portion in the thickness direction.

18. The fixing device according to claim 17, wherein a portion of the holding member, the portion facing the downstream-side first end portion in the transport direction, has a first height in the thickness direction, and portions of the holding member, the portions facing the downstream-side second end portions in the transport direction, each have a second height in the thickness direction that is the same as the first height.

19. An image forming apparatus comprising:

an image forming unit that forms an unfixed image; and the fixing device according to claim 1 that fixes the unfixed image onto the recording medium by applying heat and pressure to the unfixed image.

* * * * *